US009106988B2

(12) United States Patent
Noro

(10) Patent No.: US 9,106,988 B2
(45) Date of Patent: Aug. 11, 2015

(54) ELECTROACOUSTIC TRANSDUCER

(71) Applicant: Yamaha Corporation, Hamamatsu-Shi, Shizuoka-Ken (JP)

(72) Inventor: Masao Noro, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 14/519,512

(22) Filed: Oct. 21, 2014

(65) Prior Publication Data

US 2015/0110304 A1 Apr. 23, 2015

(30) Foreign Application Priority Data

Oct. 22, 2013 (JP) ..... 2013-219607
Nov. 18, 2013 (JP) ..... 2013-237777
Sep. 30, 2014 (JP) ..... 2014-200339

(51) Int. Cl.

*H04R 1/00* (2006.01)
*H04R 7/00* (2006.01)
*H04R 7/12* (2006.01)
*H04R 9/06* (2006.01)

(52) U.S. Cl.

CPC .. *H04R 1/00* (2013.01); *H04R 7/00* (2013.01); *H04R 7/12* (2013.01); *H04R 7/127* (2013.01); *H04R 9/063* (2013.01); *H04R 2207/00* (2013.01)

(58) Field of Classification Search

CPC ..... H04R 1/00; H04R 1/24; H04R 7/02; H04R 7/12; H04R 7/122; H04R 7/127; H04R 7/16; H04R 7/18; H04R 9/06; H04R 9/063; H04R 2207/00

USPC ..... 381/182, 186, 190, 398, 423, 424, 430, 381/432; 181/147, 163, 164, 165, 171, 172, 181/173

See application file for complete search history.

(56) References Cited

U.S. PATENT DOCUMENTS 1,667,149 A * 4/1928 Gerlach ..... 381/163
5,652,801 A * 7/1997 Paddock ..... 381/190
6,061,461 A * 5/2000 Paddock ..... 381/424

(Continued)

FOREIGN PATENT DOCUMENTS

EP 0 077 228 A2 4/1983
EP 1182907 B1 2/2002

(Continued)

OTHER PUBLICATIONS

Extended European Search Report mailed Mar. 25, 2015, for EP Application No. 14189883.3, nine pages.

*Primary Examiner* — Huyen D Le
(74) *Attorney, Agent, or Firm* — Morrison & Foerster LLP

(57) ABSTRACT

An electroacoustic transducer includes a diaphragm including: a wing-pair portion; and a cone portion. The wing-pair portion includes a pair of convex surfaces having respectively convex surfaces of a pair of longitudinal split tubular members. A valley is formed between one side portions of the pair of convex surfaces. The cone portion surrounds an outer peripheral portion of the wing-pair portion and extends in a conical shape. The electroacoustic transducer further includes: a converter configured to convert between a vibration of the diaphragm in a depth direction of the valley and an electric signal corresponding to the vibration; and a supporter supporting an outer peripheral portion of the cone portion to allow the diaphragm to vibrate in a direction of the vibration.

12 Claims, 9 Drawing Sheets

(56) References Cited

U.S. PATENT DOCUMENTS

| | | | | |
|---|---|---|---|---|
| 7,672,472 | B2 * | 3/2010 | Oxford et al. | 381/423 |
| 8,135,160 | B2 | 3/2012 | Mitobe et al. | |
| 2003/0024763 | A1 | 2/2003 | Hachiya et al. | |
| 2006/0050924 | A1 | 3/2006 | Ohara | |
| 2007/0147651 | A1 | 6/2007 | Mitobe et al. | |

FOREIGN PATENT DOCUMENTS

| | | | |
|---|---|---|---|
| EP | 1 280 378 | A2 | 1/2003 |
| JP | 2002-078079 | A | 3/2002 |
| JP | 2007-174233 | A | 7/2007 |
| WO | WO-97/46046 | A1 | 12/1997 |

* cited by examiner

ELECTROACOUSTIC TRANSDUCER

CROSS REFERENCE TO RELATED APPLICATION

The present application claims priority from Japanese Patent Application Nos. 2013-219607 filed on Oct. 22, 2013, 2013-237777 filed on Nov. 18, 2013, and 2014-200339 filed on Sep. 30, 2014, the disclosures of which are herein incorporated by reference in its entirety.

BACKGROUND

1. Technical Field

The present invention relates to an electroacoustic device for a speaker configured to reproduce sound by vibrating convex surfaces and a microphone configured to pick up sound.

2. Description of the Related Art

A typical dynamic speaker includes a vibration plate or a diaphragm and a voice coil motor which moves the vibration plate back and forth to cause piston motion for producing sound. The typical dynamic speaker functions substantially as a point sound source and exhibits wide directivity at low frequencies but exhibits sharp directivity over a frequency range equal to or higher than a frequency at which the diameter of a bore of the vibration plate is substantially equal to a half-wavelength of the reproduced sound. Thus, a small speaker using a vibration plate having a small bore is used to reproduce sound at high frequencies. This also applies to a dynamic microphone whose operation principle is reverse to that of the dynamic speaker. That is, a small microphone using a vibration plate having a small bore is used to pick up high frequencies with wide directivity.

In a riffell speaker, in contrast, a vibration plate is constituted by a pair of rectangular curved plates, and the directivity is wide at middle and high frequencies. Also, sound produced by the riffell speaker radiates in a widthwise direction of the vibration plate or a horizontal direction along a direction of curve of the vibration plate and hardly radiates in a lengthwise direction of the vibration plate or a vertical direction. Accordingly, it is considered that a plurality of speakers of this type can be continuously arranged as a line array speaker in the vertical direction to provide an ideal sound space.

Patent Document 1 (Japanese Patent Application Publication No. 2002-78079) and Patent Document 2 (Japanese Patent Application Publication No. 2007-174233) disclose conventional riffell speakers.

Patent Document 1 discloses a speaker in which a conductor pattern as a voice coil is printed on a central portion of a polymeric resin film, and the central portion is folded and bonded to form a vibration plate which includes first and second curved vibration portions and a planar plate portion having the conductor pattern, the planar plate portion and first and second curved vibration portions being formed integrally with each other. The planar plate portion of the vibration plate is disposed in a magnetic gap formed in a magnetic circuit, and distal edges of the first and second curved vibration portions are secured to a supporter.

Patent Document 2 discloses a speaker in which a central portion of a vibration plate is folded so as to form a recessed portion in which a flat voice coil wound in an oval annular shape is disposed in two magnetic gaps spaced apart from each other in an up and down direction. Also in this speaker, an outer peripheral portion of the vibration plate is secured to an annular frame.

SUMMARY

However, since the riffell speaker of this type is not appropriate for reproducing sound at low frequencies, a multi-speaker system using a speaker for low frequencies (i.e., a woofer) needs to be additionally configured to reproduce sound over the full range of audible frequencies.

This invention has been developed to provide a low-cost electroacoustic transducer using one unit for exhibiting wide directivity over a wide frequency range extending from low frequencies to high frequencies.

The present invention provides an electroacoustic transducer including: a diaphragm including: a wing-pair portion including a pair of convex surfaces having respectively convex surfaces of a pair of longitudinal split tubular members, a valley being formed between one side portions of the pair of convex surfaces; and a cone portion surrounding an outer peripheral portion of the wing-pair portion and extending in a conical shape; a converter configured to convert between a vibration of the diaphragm in a depth direction of the valley and an electric signal corresponding to the vibration; and a supporter supporting an outer peripheral portion of the cone portion of the diaphragm so as to allow the diaphragm to vibrate in a direction of the vibration.

The present invention also provides an electroacoustic transducer including: a diaphragm including: a wing-pair portion including a pair of convex surfaces having respectively surfaces of convex members, a distance between one edge portions of the pair of convex surfaces being less than a distance between other edge portions of the pair of convex surfaces so as to form a valley between the pair of convex surfaces; and a cone portion surrounding an outer peripheral portion of the wing-pair portion and extending in a conical shape; a converter configured to convert between a vibration of the diaphragm in a depth direction of the valley and an electric signal corresponding to the vibration; a support body supporting the diaphragm and the converter; and an edge member including one edge secured to an outer peripheral portion of the cone portion and another edge secured to the support body, the edge member supporting the outer peripheral portion of the cone portion so as to allow the diaphragm to vibrate in a direction of the vibration.

BRIEF DESCRIPTION OF THE DRAWINGS

The objects, features, advantages, and technical and industrial significance of the present invention will be better understood by reading the following detailed description of the embodiments of the invention, when considered in connection with the accompanying drawings, in which.

DETAILED DESCRIPTION OF THE EMBODIMENTS

The present inventors have analyzed an operation principle of a riffell speaker and found that the width of directivity is determined due, not to vibrations at high frequencies being concentrated at a line sound source, but to the shape of a vibration plate itself, and accordingly in a case where piston motion is performed in a speaker unit including the vibration plate having a particular shape, the speaker unit can reproduce sound also at low frequencies without losing the wide directivity at high frequencies. The present inventors also have found that in a case where components used in, e.g., a typical dynamic speaker are used for such a speaker unit, the speaker unit can be manufactured with lower cost.

Hereinafter, there will be described embodiments of the present invention by reference to the drawings. Specifically, speakers to which electroacoustic devices according to the present invention are applied will be explained.

FIGS. 1-8 illustrate a speaker (as one example of an electroacoustic device) according to a first embodiment of the present invention.

The speaker according to the present embodiment includes: a diaphragm 1; an actuator 2 (as one example of a converter) for causing reciprocation of the diaphragm 1; a support frame 3 for supporting the diaphragm 1 and the actuator 2; and an edge member 4 for supporting the diaphragm 1 such that the diaphragm 1 is reciprocable relative to the support frame 3.

Figure 2:
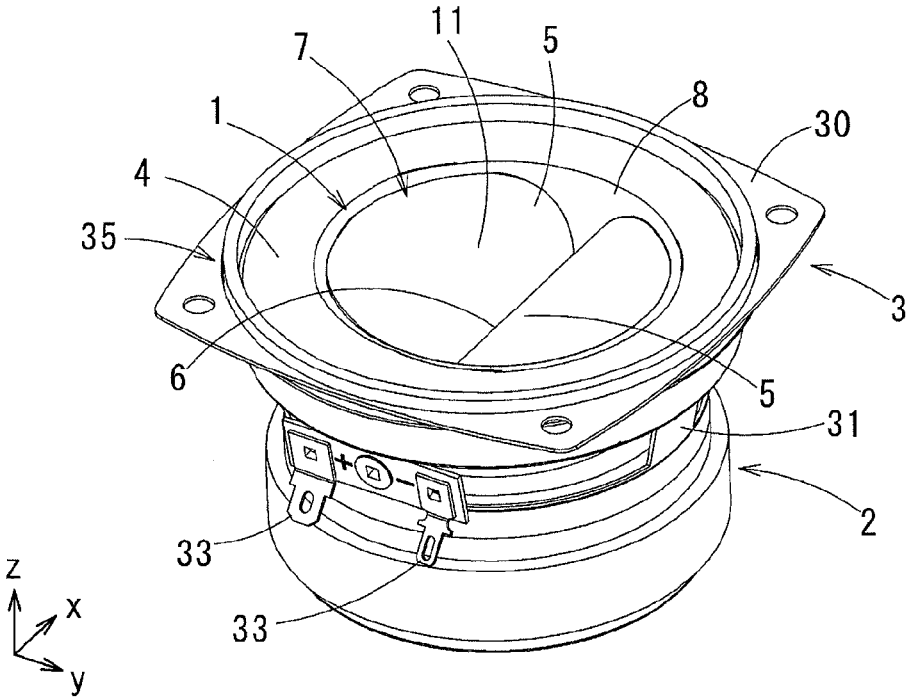
FIG. 2 is a perspective view of the speaker in its assembled state.
Figure 3:
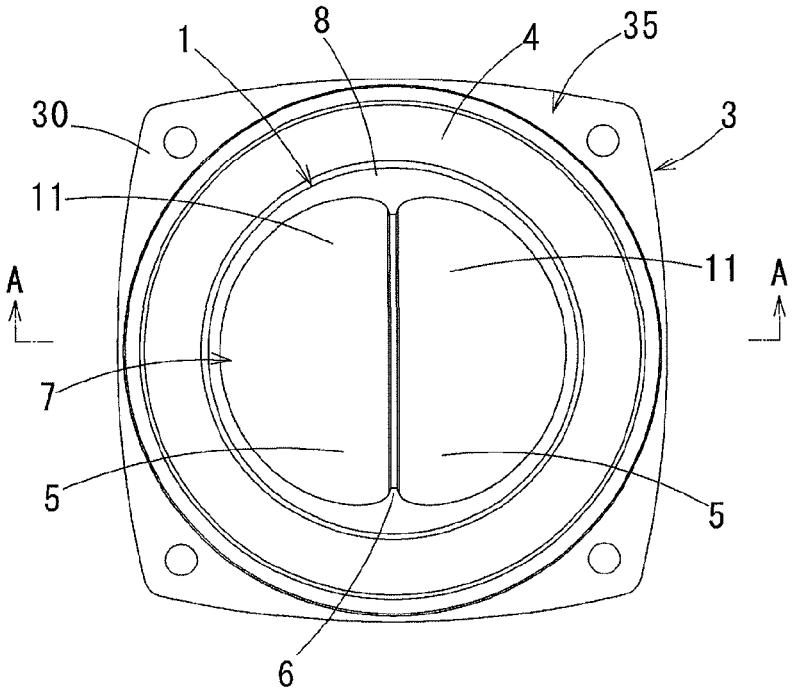
FIG. 3 is a top view of the speaker in FIG. 2.

In the state illustrated in FIG. 2, an up and down direction is defined such that the upper side is a side on which the edge member 4 is provided, and the lower side is a side on which the actuator 2 is provided. Also, a direction in which a valley 6 of the diaphragm 1 which will be described below extends is defined as a front and rear direction, and a direction perpendicular to this direction is defined as a right and left direction. Also, a surface which faces upward and a surface which faces downward are respectively defined as a front surface and a back surface. As illustrated in FIG. 2, the front and rear direction, the right and left direction, and the up and down direction may be hereinafter referred to as an x direction, a y direction, and a z direction, respectively.

Figure 6:
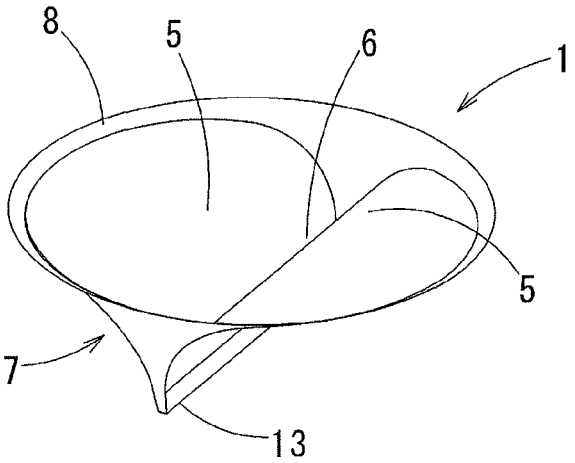
FIG. 6 is a perspective view of a diaphragm used in the speaker in FIG. 1.
Figure 7:
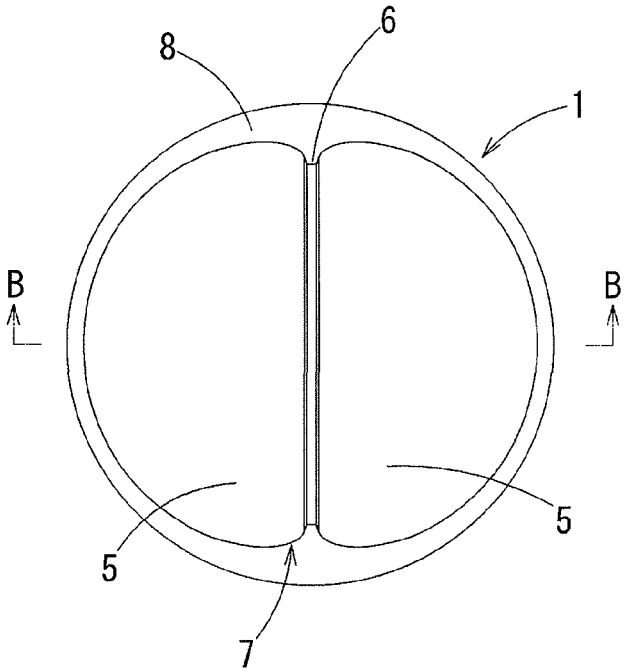
FIG. 7 is a top view of the diaphragm in FIG. 6.

As illustrated in FIGS. 6 and 7 in enlargement, the diaphragm 1 includes a wing-pair portion 7 and a cone portion 8 surrounding an outer peripheral portion of the wing-pair portion 7 and extending in a shape of a circular conical surface. The wing-pair portion 7 has a surface in which convex surfaces 5 of the pair of longitudinal split tubular members are arranged in parallel, and a valley 6 is formed between one side portions of the respective convex surfaces 5 which are adjacent to each other (or between the respective convex surfaces 5 of the pair of longitudinal split tubular members). It is noted that the pair of longitudinal split tubular members are two of a plurality of members obtained by splitting a tubular member in its longitudinal direction or an axial direction of the tubular member.

The illustrated wing-pair portion 7 is constituted by a pair of curved plates 11 as the pair of longitudinal split tubular members having the respective convex surfaces 5. Side portions of the curved plates 11 are bonded to each other so as to form the valley 6 of the curved plates 11. The cone portion 8 extends from side portions (i.e., edge portions) of the respective curved plates 11 which are opposite the joint portion 13 and closes opposite ends of the valley 6 of the curved plates 11 in the front and rear direction so as to be shaped like a circular conical surface in its entirety.

Figure 4:
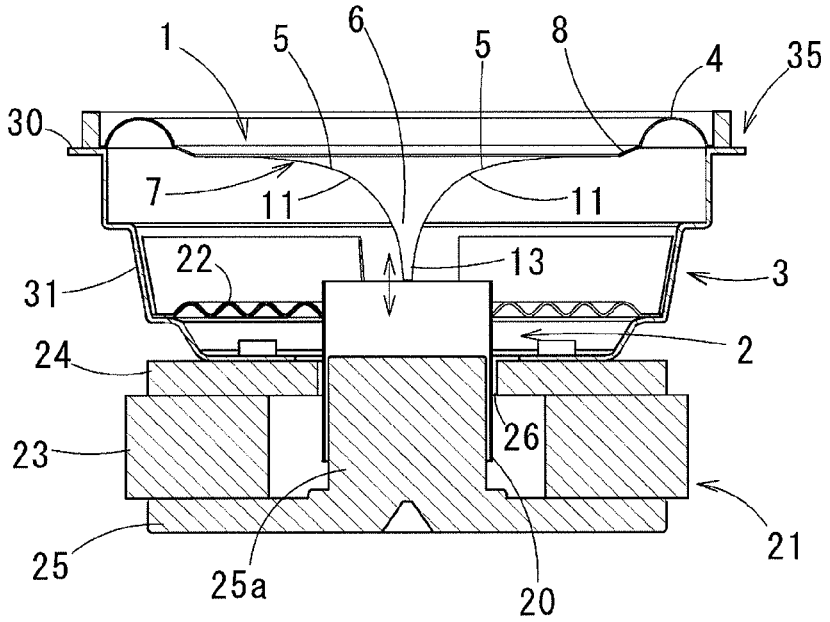
FIG. 4 is a cross-sectional view taken along line A-A in FIG. 3.
Figure 5:
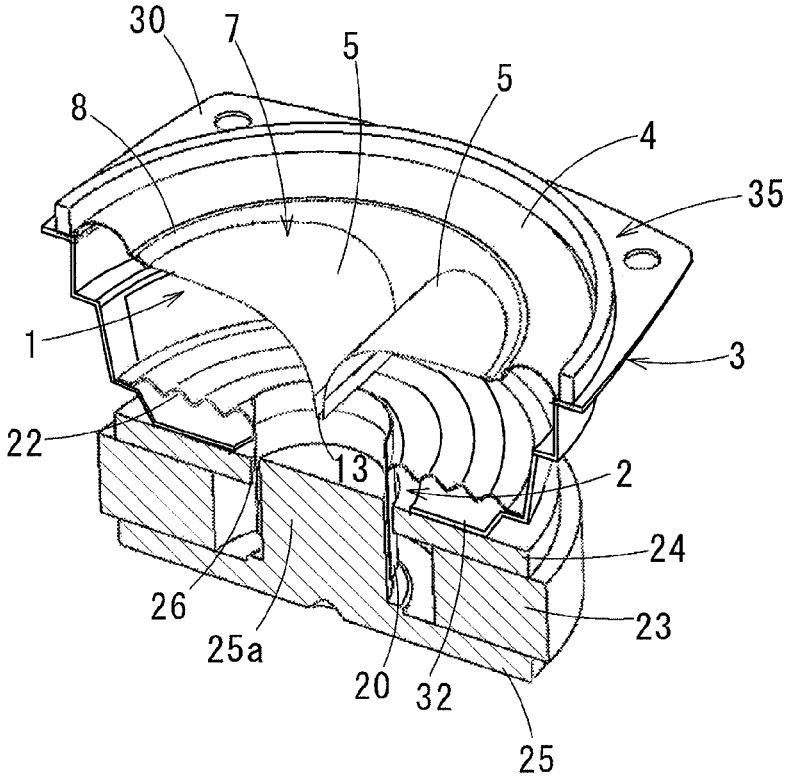
FIG. 5 is a perspective view illustrating a half portion of the speaker in FIG. 2 in cross section.
Figure 8:
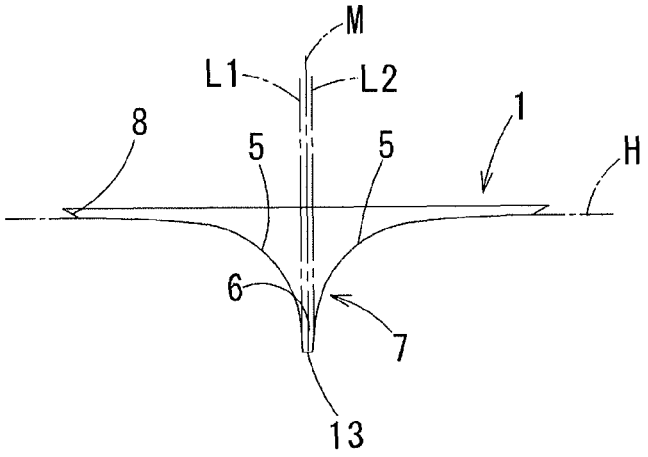
FIG. 8 is a cross-sectional view taken along line B-B in FIG. 7.

That is, as illustrated in FIGS. 4 and 8 in cross section, this diaphragm 1 is constructed such that the joint portion 13 of the curved plates 11 is disposed at their respective lower edges, and accordingly the wing-pair portion 7 is constituted by the most portion of the curved plates 11 above the joint portion 13 in a height direction of the curved plates 11 and such that the cone portion 8 is disposed at an upper edge portion of the wing-pair portion 7 and opposite end portions of the valley 6 so as to partly constitute the circular conical surface.

The pair of convex surfaces 5 formed by the pair of curved plates 11 are arranged so as to face each other. In other words, the pair of curved plates 11 are arranged such that the convex surface 5 of one of the pair of curved plates 11 and a concave surface of the other of the pair of curved plates 11 do not face each other and such that concave surfaces of the pair of curved plates 11 do not face each other. The pair of convex surfaces 5 are arranged such that a distance between one edge portions of the pair of convex surfaces 5 is less than a distance between the other edge portions of the pair of convex surfaces 5 or such that the other edge portions of the pair of convex surfaces 5 are spaced apart from each other, and the one edge portions of the pair of convex surfaces 5 are held in contact with each other, whereby the valley 6 having a bottom near the one edge portions is formed between the pair of convex surfaces 5.

Each of the convex surfaces 5 of the respective curved plates 11 is not limited to a single arc surface and may be a surface having a continuous series of curvatures, a surface whose cross section along the circumferential direction of each convex surface 5 (i.e., in the right and left direction) has a curvature which changes continuously or which is constant like a parabola and a spline curve, a surface shaped like a surface of a polygonal tube, and a surface having a plurality of step portions. Each convex surface 5 in the present embodiment curves in one direction, i.e., the circumferential direction of each convex surface 5 or the right and left direction and extends straight in a direction perpendicular to the one direction, i.e., the front and rear direction (the lengthwise direction of the convex surface 5) or the axial direction of the tubular member of each longitudinal split tubular member. However, each convex surface 5 may be a curved surface or a convex surface formed such that the curvature of a cross section of the surface along the front and rear direction is less than that of a cross section of the surface along the right and left direction (noted that the curvature of the cross section of the surface along the right and left direction may be a constant curvature or a plurality of curvatures which are changed continuously). The pair of curved plates 11 are arranged in parallel so as to project in the same direction, i.e., toward the same surface side, and the adjacent side portions are bonded in a state in which directions of tangents of the respective side portions are substantially parallel with each other. At the joint portion 13, as illustrated in FIG. 8, the curved plates 11 are bonded to each other with a slight space therebetween, and accordingly tangents L1, L2 at the joint portion 13 are parallel with each other. The valley 6 is formed between the curved plates 11 along this joint portion 13 so as to extend along a straight line extending in the lengthwise direction of the convex surface 5.

Accordingly, as illustrated in FIGS. 6 and 7, the joint portion 13 of the wing-pair portion 7 extends straight in a diameter direction of the cone portion 8 at a lower end portion of the diaphragm 1.

To produce uniform reproduced sound, the curved plates 11 are preferably formed such that their respective cross sections are symmetric with respect to a plurality of lines M passing through centers between the tangents L1, L2 at the joint portion 13. In the present invention, however, the cross sections of the curved plates 11 do not necessarily need to have the line symmetry.

This diaphragm 1 may be formed of any material such as synthetic resin, paper, and metal which are typically used for vibration plates of speakers. For example, the diaphragm 1 can be formed relatively easily by vacuum forming of a film formed of synthetic resin such as polypropylene and polyester.

The diaphragm 1 according to the present embodiment is constituted by a single film formed of synthetic resin, and the joint portion 13 is formed by folding a central portion of the film in U-shape in cross section.

The actuator 2 is, for example, a voice coil motor which is constituted by a voice coil 20 provided on the joint portion 13 of the curved plates 11 and a magnet mechanism 21 secured to the support frame 3.

The voice coil 20 is constituted by a cylindrical bobbin 20*a* and a coil 20*b* wound on the bobbin 20*a*. An upper end of the voice coil 20 and a lower edge of the joint portion 13 are bonded by, e.g., an adhesive such that the joint portion 13 of the curved plates 11 is disposed in the diameter direction of the voice coil 20. An outer circumferential portion of the voice coil 20 is supported by the support frame 3, with a damper 22 disposed therebetween. The voice coil 20 is reciprocable with respect to the support frame 3 in the axial direction of the voice coil 20. The dampers 22 may be formed of a material which is used for the typical dynamic speaker.

The magnet mechanism 21 includes an annular magnet 23, a ring-shaped outer yoke 24 secured to one of opposite poles of the magnet 23, and an inner yoke 25 secured to the other of the opposite poles of the magnet 23. A distal end portion of a pole 25*a* standing on a center of the inner yoke 25 is disposed in the outer yoke 24, whereby an annular magnetic gap 26 is formed between the outer yoke 24 and the inner yoke 25, and an end portion of the voice coil 20 is disposed in the magnetic gap 26.

The support frame 3 is formed of metal, for example. In the illustrated example, the support frame 3 includes: a flange portion 30 shaped like a rectangular frame; a plurality of arm portions 31 extending downward from the flange portion 30; and an annular frame portion 32 formed on lower ends of the respective arm portions 31. An inner circumferential surface of the flange portion 30 is a ring-shaped outer circumferential surface in which the diaphragm 1 is disposed, with the joint portion 13 being located at the lower end of the diaphragm 1. An upper end edge of the cone portion 8 of the diaphragm 1 is supported by an upper surface of the flange portion 30 via the edge member 4. Accordingly, the edge member 4 is formed so as to have a round ring shape corresponding to the cone portion 8 of the diaphragm 1. This edge member 4 can be formed of a material which is used for the typical dynamic speaker. It is noted that the diaphragm 1 and the edge member 4 are formed such that the degree of difficulty in deformation, i.e., stiffness of the diaphragm 1 in the depth direction of the valley 6 is greater than the degree of difficulty in deformation of the edge member 4 in the depth direction of the valley 6, i.e., stiffness of the edge member 4 in the depth direction of the valley 6. In other words, the diaphragm 1 and the edge member 4 are constructed such that an amount of deformation of the diaphragm 1 which is caused by vibration of the diaphragm 1 in the depth direction of the valley 6 is less than an amount of deformation of the edge member 4 which is caused by vibration of the diaphragm 1 in the depth direction of the valley 6.

In the present embodiment, the support frame 3 and the edge member 4 constitute a support portion 35 for supporting the diaphragm 1 such that the diaphragm 1 can be vibrated in the depth direction of the valley 6, i.e., the z direction.

It is noted that one edges of the edge member 4 are secured to outer peripheral portions of the respective curved plates 11 in the right and left direction, i.e., the edge portions of the curved plates 11 (i.e., connection edges of the curved plates 11 which are connected to the edge member 4) which are opposite the edge portions thereof on which the joint portion 13 is provided, and the other edges of the edge member 4 are secured to the support frame 3. Accordingly, deformation of the edge member 4 allows the outer peripheral portion of the respective curved plates 11 to vibrate relative to the support frame 3 in the up and down direction. In other words, the edge member 4 supports the diaphragm 1 while allowing the entire diaphragm 1 to vibrate in the up and down direction.

In a state in which the diaphragm 1 is mounted on the support frame 3, as illustrated in FIG. 8, when it is assumed that a line connecting outermost distal edges of the respective convex surfaces 5 along directions of curves of the respective convex surfaces 5 (in the illustrated example, a tangent at a position where the cone portion 8 is connected to a distal edge of each curved plate 11 which is located opposite from the joint portion 13) is defined as a boundary line H, each of the convex surfaces 5 is curved such that the distance between the convex surface 5 and the boundary line H becomes gradually larger in a direction from the corresponding distal edge toward the valley 6.

As described above, each of the convex surfaces 5 is not limited to a single arc surface and may be a surface having a continuous series of curvatures, a surface whose cross section has a curvature which changes continuously or which is constant like a parabola and a spline curve, a surface shaped like a surface of a polygonal tube, and a surface having a plurality of step portions, but each of the convex surfaces 5 is preferably shaped so as not to project from the boundary line H connecting the distal edges of the respective convex surfaces 5.

Figure 1:
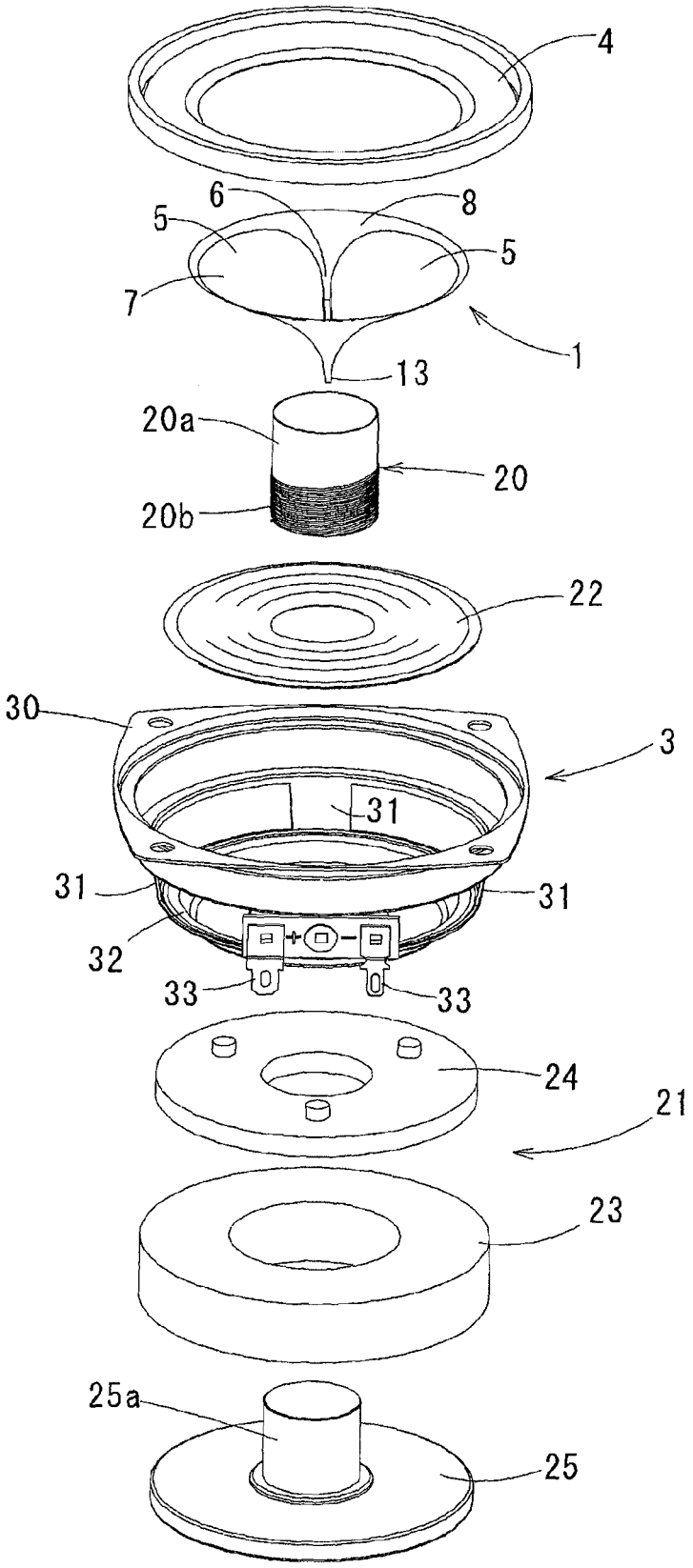
FIG. 1 is an exploded perspective view of a speaker according to a first embodiment of the present invention.

It is noted that reference numerals 33 in FIGS. 1 and 2 denote terminals for connecting the voice coils 20 to external devices.

In the speaker constructed as described above, when a drive current based on a voice signal is supplied to the voice coil 20 of the actuator 2 secured to the diaphragm 1, a driving force generated based on the drive current is applied to the voice coil 20 by a change in magnetic flux generated by the drive current and a magnetic field in the magnetic gap 26, the voice coil 20 is vibrated in a direction perpendicular to the magnetic field (i.e., the axial direction of the voice coil 20 or the up and down direction indicated by the arrows in FIG. 4). When the diaphragm 1 connected to the voice coil 20 vibrates in the depth direction of the valley 6, reproduced sound radiates from the surface of the diaphragm 1.

The diaphragm 1 is constituted by: the wing-pair portion 7 disposed so as to constitute the most portion of the diaphragm 1 in its height direction; and the cone portion 8 disposed so as to constitute only a small portion of an upper end portion of the diaphragm 1 in its height direction. Thus, most part of reproduced sound is radiated from the convex surfaces 5 of the wing-pair portion 7.

Accordingly, like the vibration plate used in the riffell speaker, the directivity of sound reproduced by the convex surfaces 5 is wide in the right and left direction along the circumferential direction of each convex surface 5 and narrow in the front and rear direction. Also, the directivity of sound reproduced by the convex surfaces 5 is wide at middle and high frequencies as in the vibration plate used in the riffell speaker.

Furthermore, the diaphragm 1 is supported at its outer peripheral portion of the cone portion 8 by the edge member 4 so as to be movable back and forth with respect to the support frame 3. Thus, the entire diaphragm 1 extending from the joint portion 13 to the outer peripheral portion vibrates uniformly by the actuators 2, in other words, the diaphragm 1 is vibrated by what is called piston motion. Accordingly, like the dynamic speaker, the diaphragm 1 provides a high sound pressure also at low frequencies. If the opposite ends of the valley 6 are open, a sound wave radiated from the diaphragm 1 partly passes through the openings toward the back side of each curved plate 11. In the above-described embodiment, however, the opposite ends of the valley 6 are closed by the cone portion 8, preventing the sound wave from going toward the back side of each curved plate 11, whereby the diaphragm 1 can efficiently emit sound from the entire front surface of the diaphragm 1.

This construction enables a single speaker unit to function as a full-range speaker unit capable of reproducing sound having wide directivity over the full range of audible frequencies including low frequencies and middle and high frequencies. A line array speaker system can be provided by arranging a plurality of speakers having the above-described construction in a line such that the valleys 6 of the respective vibration bodies 1 are aligned to each other, which can provide a sound space with an ideal line sound source.

Also, in the present embodiment, since the outer peripheral portion of the diaphragm 1 is constituted by the cone portion 8 shaped like the circular conical surface, the edge member 4 can be shaped like a round ring, that is, the edge member 4 can be formed in a simple shape. Also, the voice coil 20 of the actuator 2 has a cylindrical shape whose upper end portion is bonded to the diaphragm 1 in the present embodiment. Thus, actuators used in a typical dynamic speaker can be used for the actuator 2, and accordingly the same components as used in a dynamic speaker including a typical conical vibration plate can be used as components such as the edge member 4, the support frame 3, and the actuator 2, resulting in reduced cost for manufacturing.

While the wing-pair portion 7 is constituted by a single film in the present embodiment, the wing-pair portion 7 may be constituted by bonding one edge portions of two curved plates to each other. While the joint portion 13 of the curved plates 11 is formed by folding the film in a U-shape in cross section in the present embodiment, the joint portion 13 may be formed by folding the film in a V-shape, may be formed by bonding one side portions of the two curved plates 11 to each other with a predetermined width such that the joint portion 13 is shaped like a plate strip, and may be formed by bonding a reinforcing plate in the form of a plate strip different from the curved plates or a reinforcement such as a reinforcing wire, to the joint portion along it to reinforce the joint portion along a straight line, for example.

In any construction, each of the convex surfaces 5 is preferably formed not to project from the boundary line H connecting the distal edges of the side portions of the respective curved plates 11 which are opposite the joint portion 13.

FIGS. 9-14 illustrate vibration bodies according to other embodiments. Components other than the diaphragm such as the actuator, the support body, and the edge member which are used in the first embodiment are also used in these embodiments. Thus, illustrations for these components are omitted, and the same reference numerals as used in the first embodiment are used to designate the corresponding elements of these embodiments, and an explanation of which is simplified.

Figure 9:
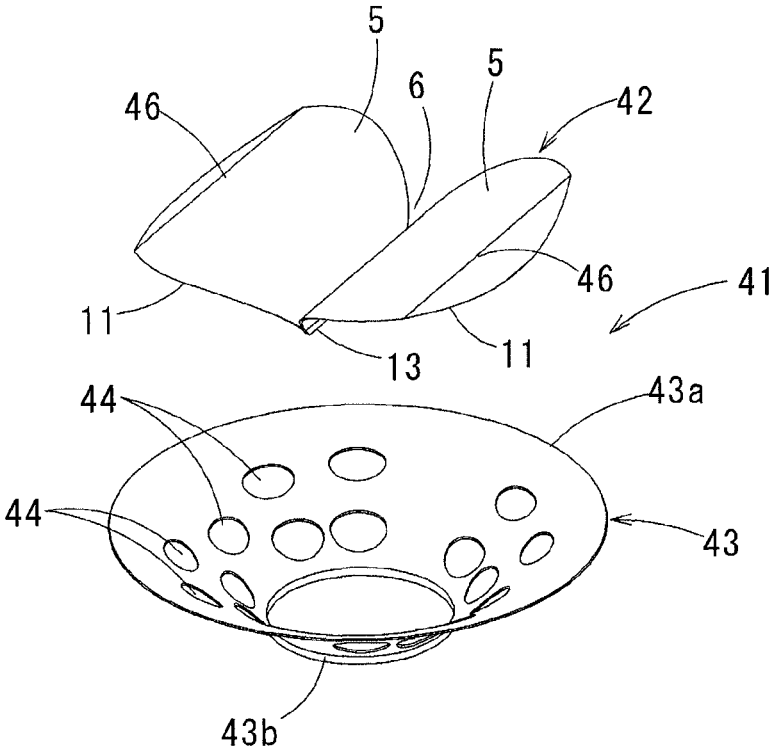
FIG. 9 is an exploded perspective view of a diaphragm according to a second embodiment of the present invention.
Figure 10:
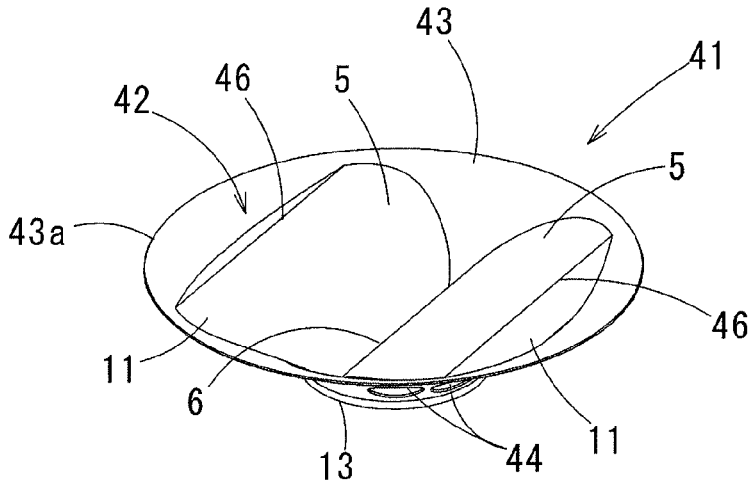
FIG. 10 is a perspective view of the diaphragm in FIG. 9 in its assembled state.
Figure 11:
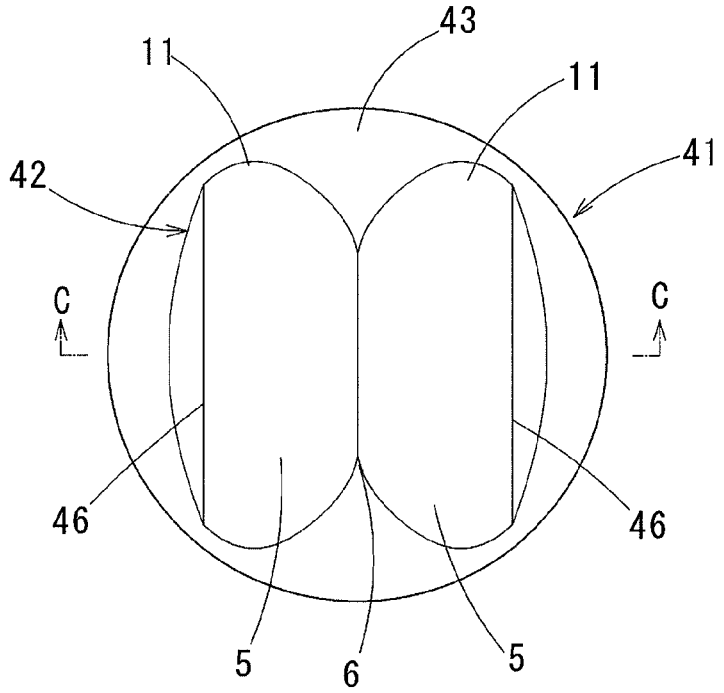
FIG. 11 is a top view of the diaphragm in FIG. 10.

FIGS. 9-12 illustrate a diaphragm 41 in a second embodiment. As illustrated in FIG. 9 in exploded form, a wing-pair portion 42 and a cone portion 43 are separately formed, and the wing-pair portion 42 is bonded to a front surface of the cone portion 43. As in the first embodiment, the wing-pair portion 42 are constituted by the pair of curved plates 11 formed so as to be curved along the respective convex surfaces 5, and side or edge portions of the curved plates 11 which form the valley 6 are joined to each other.

Figure 12:
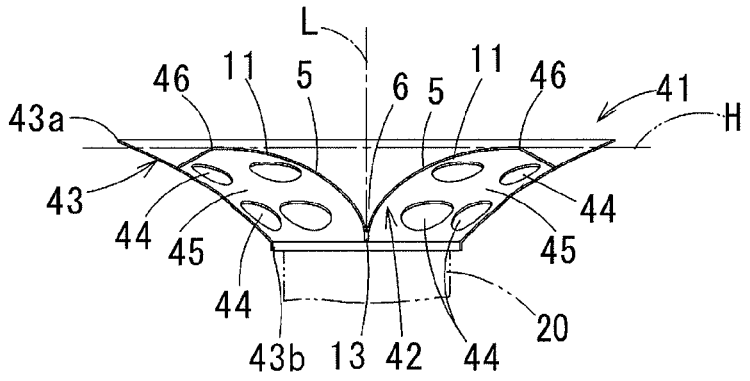
FIG. 12 is a cross-sectional view taken along line C-C in FIG. 11.

The cone portion 43 is shaped like a circular conical surface and has a large-diameter edge 43*a* and a small-diameter edge 43*b*. The wing-pair portion 42 is bonded to a central portion of the cone portion 43 except the large-diameter edge 43*a* and the small-diameter edge 43*b*. This central portion has a plurality of through holes or bores 44. The wing-pair portion 42 is bonded to the front surface of the cone portion 43 so as to cover the area in which the through holes 44 of the cone portion 43 are formed. Thus, as illustrated in FIG. 12, a space 45 is formed between the cone portion 43 and the wing-pair portion 42 so as to open in a back side of the cone portion 43 through the through holes 44.

Each of the side portions of the respective curved plates 11 of the wing-pair portion 42 which are opposite the joint portion 13 is bent at a bent portion 46 extending in the longitudinal direction of the convex surfaces 5, resulting in increase in stiffness of the side portion.

When it is assumed that a line passing through tops of the bent portions 46 of the respective convex surfaces 5 is defined as a boundary line X, each of the convex surfaces 5 is curved from the top of the bent portion 46 toward the valley 6 in a direction gradually away from the boundary line X so as not to project from the boundary line X.

In the wing-pair portion 7 in the first embodiment, as illustrated in FIG. 8, the tangent L1 and the tangent L2 are formed in parallel with each other at the joint portion 13 of the curved plates 11. In the wing-pair portion 42 in the second embodiment, however, as illustrated in FIG. 12, the side portions of the respective curved plates 11 are bonded to each other, so that the tangent at the joint portion 13 for one of the curved plates 11 coincides with the tangent at the joint portion 13 for the other of the curved plates 11, resulting in a single tangent L being formed at the joint portion 13.

As illustrated in FIG. 12, the joint portion 13 of the curved plates 11 is disposed above a lower end of the small-diameter edge 43*b* of the cone portion 43 so as not to project from the lower end of the small-diameter edge 43*b*, and a lower end portion of the diaphragm 41 is constituted by the small-diameter edge 43*b* of the cone portion 43. Accordingly, the voice coil 20 of the actuator is secured to the joint portion 13 of the curved plates 11 in a state in which the voice coil 20 is spaced apart from the small-diameter edge 43*b* of the cone portion 43. The voice coil 20 is thus disposed not near the large-diameter edge 43*a* of the cone portion 43 but near the small-diameter edge 43*b* of the cone portion 43 to drive or move the joint portion 13.

In this speaker, the diaphragm 41 is driven by the actuator in the depth direction of the valley 6 of the wing-pair portion 42, which vibrates the entire diaphragm 41 due to piston motion, whereby sound is radiated from the convex surfaces 5 of the wing-pair portion 42. If the space 45 formed between the cone portion 43 and the wing-pair portion 42 is an enclosed space in the above-described construction, the space may cause cavity resonance and interference of sound due to overlap of two vibration plates. In the diaphragm 41 in the present embodiment, however, the space 45 is opened by the through holes 44, and the area of a portion of the cone portion 43 which overlaps the wing-pair portion 42 is reduced by the through holes 44 to lower the function as a vibration plate.

Accordingly, reproduced sound can be effectively radiated from the convex surfaces 5 without affected by the cone portion 43 disposed on a back side of the wing-pair portion 42.

It is noted that only one of the through holes 44 may be formed in the cone portion 43, and one or a plurality of through holes 44 may be formed as long as each through hole 44 has such a strength that the cone portion 43 can support the wing-pair portion 42.

Figure 13:
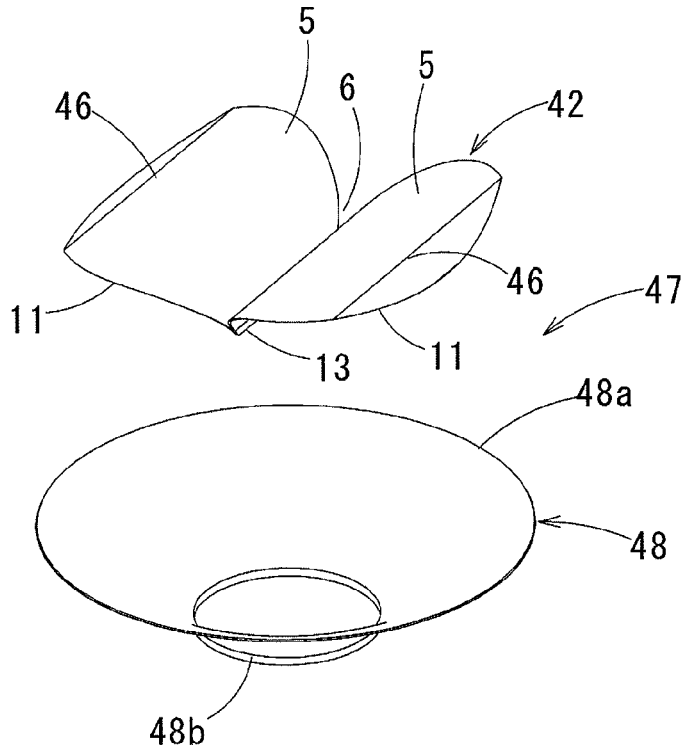
FIG. 13 is an exploded perspective view of a diaphragm according to a third embodiment of the present invention.

In the diaphragm according to the second embodiment, the through holes 44 for exposing the inside space 45 to the back side of the cone portion 43 are formed in the area of the cone portion 43 on which the wing-pair portion 42 is provided. However, the cone portion may not have the through holes 44 in the present invention. FIG. 13 is an exploded perspective view of a diaphragm having such a construction in the form of a diaphragm 47 in a third embodiment of the present invention. This diaphragm 47 is constructed such that a cone portion 48 has no through holes and such that the wing-pair portion 42 having the same construction as the wing-pair portion in the second embodiment is bonded to a front surface of a portion of the cone portion 48 between its large-diameter edge 48*a* and its small-diameter edge 48*b*.

Figure 14:
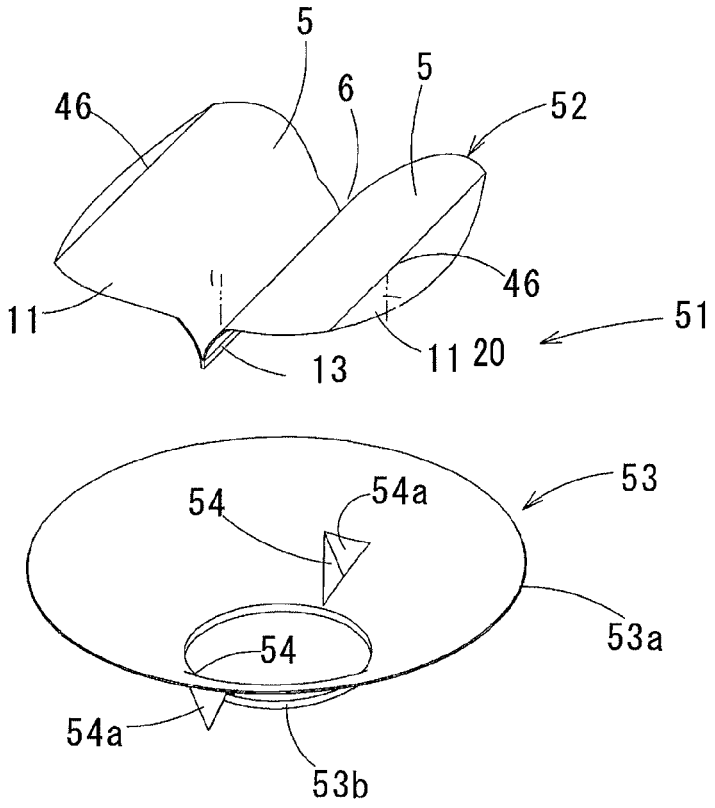
FIG. 14 is an exploded perspective view of a diaphragm according to a fourth embodiment of the present invention.
Figure 15:
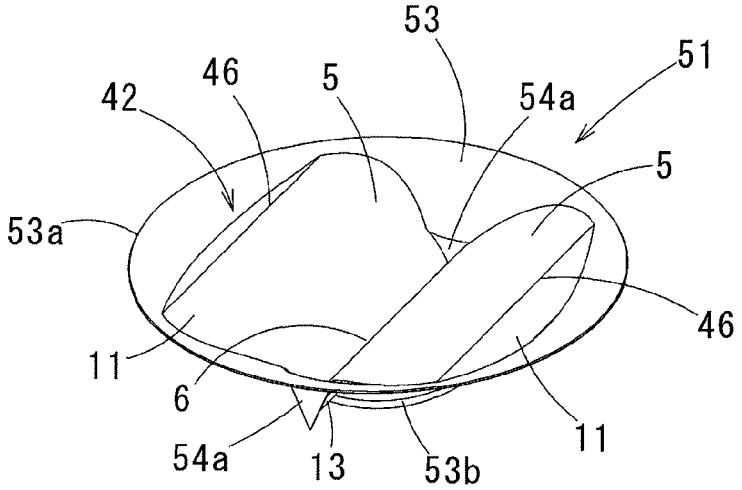
FIG. 15 is a perspective view of the diaphragm in FIG. 14 in its assembled state.

FIGS. 14 and 15 illustrate a diaphragm 51 in a fourth embodiment. As in the second embodiment, this diaphragm 51 is constructed such that a wing-pair portion 52 and a cone portion 53 are separately formed and such that the wing-pair portion 52 is bonded to a portion of the cone portion 53 between a large-diameter edge 53*a* and a small-diameter edge 53*b*. In this embodiment, the cone portion 53 has cutouts 54 in which opposite end portions of the joint portion 13 forming the valley 6 of the wing-pair portion 52 are respectively to be fitted, and the wing-pair portion 52 is bonded to the cone portion 53 in a state in which the opposite end portions of the joint portion 13 are respectively fitted in the cutouts 54.

As illustrated in FIG. 14, each of the cutouts 54 is formed by making a V-shaped slit in a portion of the cone portion 53 to form a triangle piece 54*a* and pressing this triangle piece 54*a* downward. Accordingly, as illustrated in FIG. 15, the opposite ends of the valley 6 of the wing-pair portion 52 are respectively closed by the triangle pieces 54*a*, preventing a sound wave from passing toward a back side of the cone portion 53. This makes it possible to emit sound from the entire front surface of the diaphragm 51.

The two curved plates 11 are joined to each other to form the joint portion 13 of the wing-pair portion 52. This joint portion 13 extends straight, and each of opposite end portions of the wing-pair portion 52 has a generally triangle shape that gradually spreads from the joint portion 13 as a vertex. In a construction in which the wing-pair portion is bonded to the front surface of the cone portion shaped like the circular conical surface as in the second embodiment, the wing-pair portion needs to be made gradually smaller toward the joint portion so as to match the circular conical surface of the cone portion, resulting in a short length of the joint portion. In the present embodiment, however, the cutouts 54 are formed in the cone portion 53, and the opposite end portions of the joint portion 13 are disposed in the respective cutouts 54. This construction makes it possible to bond the long joint portion 13 to the cone portion 53, resulting in a large area of the convex surfaces 5 even in the diaphragm including the cone portion 53 shaped like the circular conical surface.

In the fourth embodiment, the cone portion 53 has no through holes but may have at least one through hole in a portion of the cone portion 53 which overlaps the wing-pair portion 52 as in the second embodiment.

Figure 16:
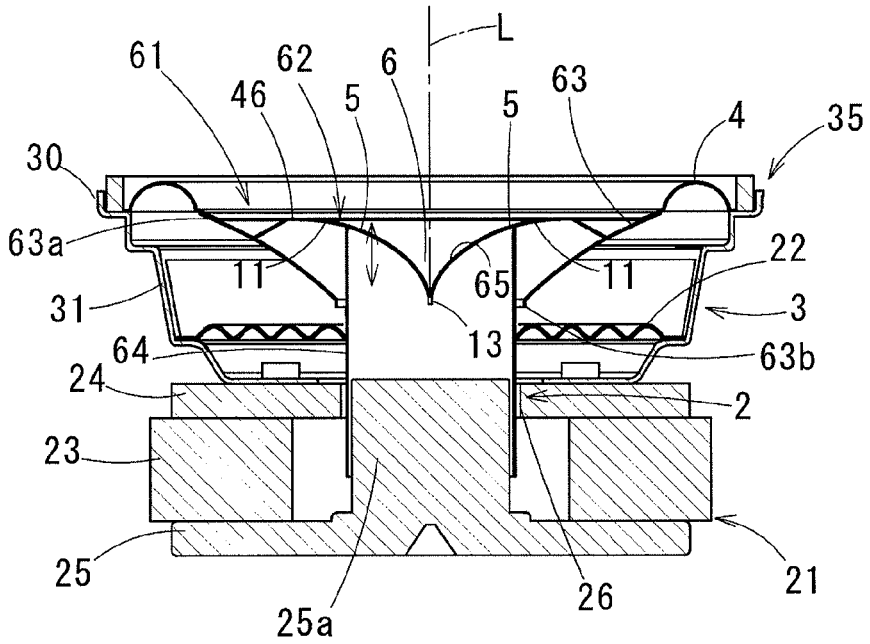
FIG. 16 is a cross-sectional view illustrating a speaker according to a fifth embodiment of the present invention as in FIG. 4.
Figure 17:
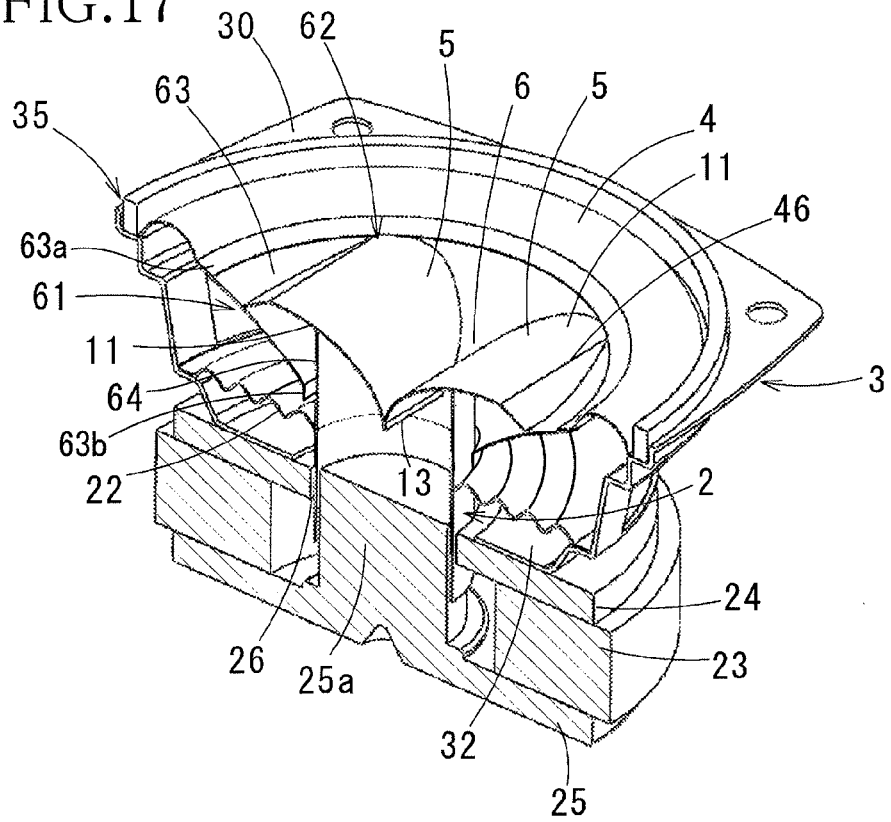
FIG. 17 is a perspective view illustrating a half portion of the speaker in FIG. 16 in cross section.

FIGS. 16 and 17 illustrate a speaker according to a fifth embodiment. It is noted that the same reference numerals as used in the first embodiment are used to designate the corresponding elements of this fifth embodiment, and an explanation of which is simplified.

The speaker according to this fifth embodiment includes a diaphragm 61 including a wing-pair portion 62 and a cone portion 63 shaped like a circular conical surface. The diaphragm 61 is constructed such that a wing-pair portion 62 is bonded to a portion of the cone portion 63 between its large-diameter edge 63*a* and its small-diameter edge 63*b*. A voice coil 64 is disposed in the small-diameter edge 63*b* disposed at a lower end portion of the diaphragm 61 in a state in which the voice coil 64 is spaced apart from the small-diameter edge 63*b*. An upper end portion of the voice coil 64 has a groove 65 extending in a diameter direction of the voice coil 64 so as to split the upper end portion into two parts, and the joint portion 13 of the wing-pair portion 62 is secured to the voice coil 64 so as to be fitted in the groove 65. The split upper end of the voice coil 64 is curved so as to be held in close contact with the back surfaces of the respective curved plates 11 of the wing-pair portion 62, and the split upper end of the voice coil 64 is bonded to the back surfaces of the respective curved plates 11. The voice coil 64 is thus disposed not near the large-diameter edge 63*a* of the cone portion 63 but near the small-diameter edge 63*b* of the cone portion 63 to drive the joint portion 13 and the back surfaces of the curved plates 11.

In this wing-pair portion 62, as illustrated in FIG. 16, the tangent at the joint portion 13 for one of the curved plates 11 coincides with the tangent at the joint portion 13 for the other of the curved plates 11, resulting in a single tangent L being formed at the joint portion 13.

The voice coil 64 in the fifth embodiment is bonded to the back surfaces of the respective curved plates 11 so as to be held in contact with the back surfaces of the respective curved plates 11 and the joint portion 13. However, the voice coil 64 may be bonded to the back surfaces of the respective curved plates 11 so as to be held in contact with the back surfaces of the respective curved plates 11 and the joint portion 13 and spaced apart from the joint portion 13 of the wing-pair portion 62.

With this construction, the wing-pair portion 62 of the diaphragm 61 is firmly bonded to the voice coil 64, allowing a driving force of the actuator 2 to be reliably transferred to the wing-pair portion 62. Also, since the upper end of the voice coil 64 is bonded to the back surfaces of the respective curved plates 11 of the wing-pair portion 62, the curved shape of the curved plates 11 is reinforced by the voice coil 64, allowing reliable transfer of piston motion to the wing-pair portion 62.

While the embodiments of the present invention have been described above, it is to be understood that the invention is not limited to the details of the illustrated embodiments, but may be embodied with various changes and modifications, which may occur to those skilled in the art, without departing from the spirit and scope of the invention.

For example, while the cone portion and the edge member are respectively shaped like a circular conical surface and a round ring in the above-described embodiments, the cone portion and the edge member may be respectively shaped like an elliptic conical surface elongated in the longitudinal direction of the wing-pair portion and an oval ring. As long as the cone portion serves as the vibration plate used for the typical dynamic speaker, the cone portion may be any shape other than the shape of the circular conical surface and the shape of the elliptic conical surface. For example, the cone portion may have a circular shape or a quadrangular shape in front view, or a shape in which a circular shape is combined with a quadrangular shape. That is, the cone portion may have any shape as long as the cone portion is conical as a whole. The shape of the wing-pair portion is changed as needed according to the shape of the cone portion.

A reinforcement such as a rib and a block may be fixed to the back surface of the diaphragm. Ribs each shaped like a plate or a rod may be provided on the convex surfaces or the radiation surfaces of the diaphragm along the right and left direction.

As described above, in the construction in which the convex surfaces serve as radiation surfaces from which reproduced sound is radiated, the directivity is wide in the right and left direction along the circumferential direction of each convex surface but narrow in the front and rear direction. Accordingly, the ribs each shaped like a plate or a rod provided on the convex surfaces or the radiation surfaces of the diaphragm along the right and left direction have little audible effects.

While the wing-pair portion is constituted by the pair of curved plates in the above-described embodiments, another pair of curved plates may be additionally provided on the opposite ends of the joint portion of the pair of curved plates such that each of the additional curved plates is perpendicular to the longitudinal direction of the joint portion.

The voice coil motor is used as a converter for moving the diaphragm back and forth, but a piezoelectric element or the like may be used instead of the voice coil motor.

While the present invention is applied to the speaker in the above-described embodiments, the present invention may also be applied to a microphone. In the case where the present invention is applied to the speaker, the converter such as the voice coil motor converts the electric signal based on the voice signal into vibration of the diaphragm. Also in the case where the present invention is applied to the microphone, the voice coil motor or the like may be used as the converter, and this converter converts, into an electric signal, vibration of the diaphragm vibrated by a sound wave. In the microphone to which the present invention is applied, the convex surfaces are vibration surfaces, and the entire diaphragm is vibrated uniformly, thereby providing good directivity with reliable sensitivity, whereby the microphone can pick up sound with wide directivity over a wide frequency range from low frequencies to high frequencies.

What is claimed is:

1. An electroacoustic transducer, comprising:

a diaphragm comprising: a wing-pair portion comprising a pair of convex surfaces comprising respectively convex surfaces of a pair of longitudinal split tubular members, a valley being formed between one side portions of the pair of convex surfaces; and a cone portion surrounding an outer peripheral portion of the wing-pair portion and extending in a conical shape;

a converter configured to convert between a vibration of the diaphragm in a depth direction of the valley and an electric signal corresponding to the vibration; and a supporter supporting an outer peripheral portion of the cone portion of the diaphragm so as to allow the diaphragm to vibrate in a direction of the vibration.

2. The electroacoustic transducer according to claim 1, wherein the wing-pair portion is disposed between a small-diameter edge of the cone portion and a large-diameter edge of the cone portion, and wherein a distance between the converter and the small-diameter edge is less than a distance between the converter and the large-diameter edge.

3. The electroacoustic transducer according to claim 2, wherein the wing-pair portion is bonded to a surface of the cone portion.

4. The electroacoustic transducer according to claim 3, wherein the cone portion comprises a through hole which opens in a space formed between the cone portion and the wing-pair portion.

5. The electroacoustic transducer according to claim 2, wherein the cone portion comprises at least one cutout in which opposite end portions of the valley of the wing-pair portion are disposed.

6. The electroacoustic transducer according to claim 1, wherein the wing-pair portion and the cone portion are formed integrally with each other in a state in which an outer peripheral edge of the wing-pair portion and an inner peripheral edge of the cone portion are continuous to each other.

7. An electroacoustic transducer, comprising:

a diaphragm comprising: a wing-pair portion comprising a pair of convex surfaces comprising respectively surfaces of convex members, a distance between one edge portions of the pair of convex surfaces being less than a distance between other edge portions of the pair of convex surfaces so as to form a valley between the pair of convex surfaces; and a cone portion surrounding an outer peripheral portion of the wing-pair portion and extending in a conical shape;

a converter configured to convert between a vibration of the diaphragm in a depth direction of the valley and an electric signal corresponding to the vibration;

a support body supporting the diaphragm and the converter; and an edge member comprising one edge secured to an outer peripheral portion of the cone portion and another edge secured to the support body, the edge member supporting the outer peripheral portion of the cone portion so as to allow the diaphragm to vibrate in a direction of the vibration.

8. The electroacoustic transducer according to claim 7, wherein the wing-pair portion is disposed between a small-diameter edge of the cone portion and a large-diameter edge of the cone portion, and wherein a distance between the converter and the small-diameter edge is less than a distance between the converter and the large-diameter edge.

9. The electroacoustic transducer according to claim 8, wherein the wing-pair portion is bonded to a surface of the cone portion.

10. The electroacoustic transducer according to claim 9, wherein the cone portion comprises a through hole which opens in a space formed between the cone portion and the wing-pair portion.

11. The electroacoustic transducer according to claim 8, wherein the cone portion comprises at least one cutout in which opposite end portions of the valley of the wing-pair portion are disposed.

12. The electroacoustic transducer according to claim 7, wherein the wing-pair portion and the cone portion are formed integrally with each other in a state in which an outer peripheral edge of the wing-pair portion and an inner peripheral edge of the cone portion are continuous to each other.

* * * * *